US006444024B1

(12) United States Patent
Mills et al.

(10) Patent No.: US 6,444,024 B1
(45) Date of Patent: Sep. 3, 2002

(54) SIZING COMPOSITION

(75) Inventors: Robert J. Mills, Marietta, GA (US); Jochen Hoffmann, Düren (DE); Ralf Krückel, Nideggen-Abenden (DE); Albert Van Den Berg, Kreuzau (DE)

(73) Assignee: Akzo Nobel NV, Arnhem (NL)

( * ) Notice: Subject to any disclaimer, the term of this patent is extended or adjusted under 35 U.S.C. 154(b) by 0 days.

(21) Appl. No.: 09/464,619

(22) Filed: Dec. 16, 1999

(51) Int. Cl.[7] ..... B21H 21/16

(52) U.S. Cl. ..... 106/287.23; 106/287.24; 162/158; 162/168.1; 162/179

(58) Field of Search ..... 162/158, 179, 162/168.1; 106/287.23, 287.24

(56) References Cited

U.S. PATENT DOCUMENTS

| | | | | |
|---|---|---|---|---|
| 3,102,064 A | | 8/1963 | Wurzburg | 162/158 |
| 3,821,069 A | | 6/1974 | Wurzburg | 162/158 |
| 3,968,005 A | | 7/1976 | Wurzburg | 162/158 |
| 4,522,686 A | | 6/1985 | Dumas | 162/158 |
| 4,695,401 A | | 9/1987 | Sweeney | 252/312 |
| 4,915,786 A | | 4/1990 | Sweeney | 162/158 |
| 4,931,197 A | | 6/1990 | Beck et al. | 252/56 R |
| 5,266,165 A | | 11/1993 | DeCleroq et al. | 162/168.2 |
| 6,165,321 A | * | 12/2000 | Pauley et al. | 162/158 |

FOREIGN PATENT DOCUMENTS

| | | | |
|---|---|---|---|
| DE | 31 36931 | 4/1983 | C08F/222/20 |
| EP | 0 707 111 | 4/1996 | D21H/17/72 |
| WO | WO 99/16973 | 4/1999 | D21H/21/16 |

* cited by examiner

*Primary Examiner*—Peter Chin
(74) *Attorney, Agent, or Firm*—Lainie E. Parker; Ralph J. Mancini

(57) ABSTRACT

The present invention relates to a substantially water-free sizing composition, an aqueous sizing dispersion and a process for the production of paper and board. The composition or dispersion comprises a cellulose reactive sizing agent and a copolymer which is prepared from a monomer mixture comprising one or more olefins and one or more derivatives of unsaturated carboxylic acids. More specifically, the composition or dispersion comprises a copolymer prepared form a monomer mixture comprising one or more α-olefins and one or more derivatives of α,β-unsaturated dicarboxylic acids.

24 Claims, No Drawings

SIZING COMPOSITION

FIELD OF THE INVENTION

This invention relates to sizing of paper and paperboard products. More specifically, the invention relates to a substantially water-free sizing composition and an aqueous sizing dispersion comprising a cellulose reactive sizing agent and a copolymer prepared from a monomer mixture comprising olefins and derivatives of unsaturated carboxylic acids.

BACKGROUND OF THE INVENTION

Cellulose-reactive sizing agents have long been used in conjunction with paper and paperboard production in order to introduce water repellence. By nature the cellulose-reactive sizing agents are hydrophobic in their character, hence, they are not easily soluble in polar solvents such as water. In order to achieve adequate sizing of the cellulose material the hydrophobic cellulose-reactive sizing agent must be finely dispersed in an aqueous medium before the sizing agent is added to the paper or paperboard wet stock.

Cellulose-reactive sizing agents derived from 2-oxetanone sizing agents are usually prepared as dispersions which are fairly stable. However, cellulose-reactive sizing agents derived from the reaction product of acid anhydrides or dicarboxylic acids and unsaturated hydrocarbons, commonly referred to as ASA sizing agents, are highly reactive, thus, they have to be prepared at the mill. As a consequence of the reactivity of the ASA sizing compounds the stability of a prepared emulsion is very limited. Another drawbacks linked to the preparation of dispersions of cellulose-reactive sizing agents are the introduction of shear forces in order to achieve finely divided/dispersed particles or droplets of the sizing agent in the aqueous phase. Shear forces are often applied by using high pressure equipment which, is cumbersome and costly.

Accordingly, one object of the present invention is to overcome the above mentioned drawbacks. Specifically, the present invention provides a sizing composition which practically is self-emulsifiable or needs low shear forces in order to obtain proper size distribution of the sizing agent in the aqueous phase.

Another object with the present invention is to further improve the dispersibility i.e. smaller particle size, of storage stable substantially water-free sizing compositions.

A still further object of the invention is to provide a storage stable substantially water-free sizing composition.

Yet another object of the present invention is to further improve the dispersability of sizing compositions comprising liquid cellulose-reactive sizing agents.

SUMMARY OF THE INVENTION

The present invention relates to a substantially water-free sizing composition, an aqueous sizing dispersion and a process for the production of paper and paperboard according to the claims. More specifically, the invention relates to a substantially water-free sizing composition and an aqueous sizing dispersion comprising a cellulose-reactive sizing agent and a copolymer prepared from a monomer mixture comprising one or more olefins and one or more derivatives of unsaturated carboxylic acids.

Cellulose-reactive sizing agents in general and especially substituted succinic anhydride sizing agents, often referred to as ASA, are unstable due to hydrolysis. Thus, aqueous dispersion comprising ASA have to be prepared close to the location of the intended use. By providing substantially water-free sizing compositions storage stability is obtained. Furthermore, substantially water-free compositions can be transported over longer distances not only due to improved stability but due to the exclusion of water. Substantially water-free sizing compositions comprising ASA or 2-oxetanone sizing agents are further more resistant to temperature changes than aqueous dispersions.

U.S. Pat. No. 4,695,401 and U.S. Pat. No. 4,915,786 refer to an ASA composition containing an emulsifier formed by the reaction of ASA and a nonionic water soluble compound having from 1 to 3 reactive polar groups. The latter compounds are exemplified particularly by polyethylene glycols or polypropylene glycols which may be capped at one end by an alkyl group. The product formed are esters, where polyalkylene glycols are linked to 1 to 3 ASA compounds.

DETAILED DESCRIPTION OF THE INVENTION

According to one preferred embodiment of the invention the cellulose-reactive sizing agent is selected among any cellulose-reactive sizing agents known in the art. The cellulose-reacive sizing agents are selected from the groups comprising 2-oxetanone sizing compounds and/or substituted succinic anhydrides, commonly referred to as ASA. and mixtures thereof, ASA being especially preferred.

Preferred 2-oxetanone sizing agents are mixtures of 2-oxetanore sizing compounds having at least one reactive 2-oxetanone group and pendant hydrophobic hydrocarbon groups. The mixture of 2-oxetanone compounds is suitably not so:id at 35° C. Preferably, the mixture of 2-oxetanone compounds is not solid at 25° C., more preferably even at 20° C. Even more preferably, the sizing agent is liquid at 35° C., more preferably at 25° C., and most preferably at 20° C. The term "liquid" apply to the sizing agent per se and not to a composition or a dispersion. The preferred structure of 2-oxetanone sizing agents is as follows:

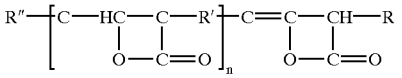

(I)

wherein n can be from 0 to 6, more preferably 0 to 3, and most preferably 0. R and R", which may be the same or different, are selected from the group of straight or branched alkyl or alkenyl chains. If n=0, then suitably not all are straight alkyl chains. Preferably, at least 25% by weight of the sizing agent consists of the 2-oxetanone structure in which at leastone of R and R" is not straight chain alkyl. R and R" can be substantially hydrophobic in nature, are suitably acyclic, and are preferably at least 6 carbon atoms in length, more preferably from 8 up to 36, most preferably from 12 up to 20 carbon atoms in length. When n>0 the sizing agents are termed 2-oxetanone multimers. R' is preferably straight chain alkyl, more preferably a straight chain alkyl containing from 6 to 16 carbon atoms, most preferably containing from 8 to 20 carbon atoms. Preferably, the 2-oxetanone sizing agent is made from fatty acids or fatty acid chlorides containing irregularities such as double bonds and chain branching. Preferred fatty acid are selected from the group comprising oleic, linoleic, linoleic, palmitoleic, dodecenoic, tetradecenoic (myristoleic), hexadecenoic (palmitoleic), octadecadienoic (linoelaidic), octadecatrienoic (linolenic), eicosenoic (gadoleic), eicosatetraenoic (archidionic), docosenoic (erucic), docosenoic (brassidic) and docosapentaenoic (clupanodinic) acids or mixtures thereof.

Suitable acid anhydrides can be characterized by the general formula (II) below, wherein $R^A$ and $R^B$ can be identical or different and represent saturated or unsaturated hydrocarbon groups suitably containing from 8 to 30 carbon atoms, or $R^A$ and $R^B$ together with the —C—O—C— moiety can form a 5 to 6 membered ring, optionally being further substituted with hydrocarbon groups containing up to 30 carbon atoms. Examples of acid anhydrides which are used commercially include alkyl and alkenyl succinic anhydrides and particularly isooctadecenyl succinic anhydride. Further examples are: iso-octadecyl succininc anhydride, n-hexadecenyl succinic anhydride, dodecenyl succinic anhydride, decenyl succininc anhydride, octenyl succinic anhydride, triisobytenyl succinic anhydride, 1-octyl-2-decenyl-succinic anhydride and 1-hexyl-2-octenyl-succinic anhydride.

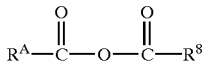

(II)

Suitable ketene dimers and acid anhydrides include the compounds disclosed in U.S. Pat. No. 4,522,686, U.S. Pat. No. 3,102,064, U.S. Pat. No. 3,821,069, U.S. Pat. No. 3,968,005 which are hereby incorporated by reference.

The copolymer used as an emulsifier in the present invention is a copolymer prepared from a monomer mixture comprising one or more olefins and one or more derivatives of unsaturated carboxylic acids, suitably the copolymer is prepared from a monomer mixture comprising one or more olefins and one or more esterified unsaturated dicarboxylic acids. Suitable copolymers are disclosed in DE 3136931 A1, which is hereby incorporated by reference.

The olefins are suitably α-olefins, usually containing from about 3 up to about 36 carbon atoms, preferably containing from about 8 up to about 30 carbon atoms, more preferably from about 12 up to about 26 carbon atoms and most preferably from 14 up to 24 carbon atoms. The α-olefins are suitably linear or branched or mixtures of linear or branched α-olefins, although linear α-olefins are more preferred.

According to one preferred embodiment of the present invention the copolymer is suitably prepared from a monomer mixture comprising one or more olefins and one or more derivatives of unsaturated carboxylic acids. The derivatives of unsaturated carboxylic acids can be esters or amides or imides. The derivatives of the unsaturated carboxylic acids can be polymerised suitably in the presence of an acrylate or an acrylic acid, thereby giving a copolyrher comprising carboxylic acid functions. If the monomer mixture is essentially free from acrylates or acrylic acids, the copolymer suitably is essentially free from carboxylic acid functions. Preferably, the derivatives of the unsaturated carboxylic acids comprise a compound comprising a hydrophilic moiety, said hydrophilic moiety being linked to the unsaturated carboxylic acid by an ester or an amide or an imide. The preferred compounds comprising a hydrophilic moiety are mentioned hereinafter.

According to yet another preferred embodiment the copolymer is suitably prepared from a monomer mixture comprising one or more olefins and one or more derivatives of unsaturated dicarboxylic acids. The term unsaturated dicarboxylic acids encompasses also unsaturated acid anhydrides where appropriate. The derivative of the unsaturated dicarboxylic acid is preferably selected from the group consisting of an ester an amide and/or an imide. The derivatives of unsaturated dicarboxylic acids suitably comprise a compound comprising a hydrophilic moiety, said hydrophilic moiety being linked to the unsaturated dicarboxylic acid by an ester or an amide or an imide. The preferred compounds comprising a hydrophilic moiety are mentioned hereinafter. Suitably, the derivatives of unsaturated dicarboxylic acids are esters of dicarboxylic acids. The copolymer or emulsifier can be prepared from a monomer mixture comprising one or more olefins and one or more esterified unsaturated dicarboxylic acids. The derivatives of unsaturated dicarboxylic acids, such as α-β-unsaturated dicarboxylic acids, usually are diesters or monoesters of unsaturated dicarboxylic acids, the monoesters being most preferred. Examples of dicarboxylic acids may be selected from the group comprising maleic acid, fumaric acid, citraconic acid, mesaconic acid, itaconic acid and aconitric acid, whereby maleic acid and fumaric acid are the most preferred.

The derivatives of unsaturated dicarboxylic acids are preferably esterified with a compound comprising a hydrophilic moiety. The compound comprising a hydrophilic moiety is suitably a polyalkyleine oxide aikyl ether.

The polyalkylene oxide alkyl ether usually comprises from 1 up to 45 alkylene oxide groups, more preferably from 5 up to 30 and most preferably from 7 up to 25 alkylene oxide groups. Suitable polyalkylene oxides are polyethylene oxides and polypropylene oxides, whereby polyethylene oxide alkyl ethers are spec,ally preferred. The alkyl group of the polyalkylene oxide alkyl ether usually is linear or branched comprising from 1 up to 36 carbon atoms, more suitably from 1 up to 8 carbon atoms, and most preferably linear alkyl groups comprising from 1 up to 8 carbon atoms.

The average molecular weight of the emulsifier, notably an emulsifier prepared from a monomer mixture comprising one or more olefins and one/or more derivatives of unsaturated dicarboxylic acids, is suitably from 1000 up to 100000, preferably from 10000 up to 50000.

The copolymers of the present invention are suitably accessible in two manners. According to one preferred embodiment the copolymer is suitably accessible by copplymerisation of an olefin and a derivative of an unsaturated dicarboxylic acid or anhydride followed by esterification with a compound comprising a hydrophilic moiety. The unsaturated dicarboxylic acids and olefins are preferably copolymerised at temperatures ranging from 70° C. up to 250° C. in the presence of a peroxide catalyst in an inert gas atmosphere. The molar ratio of unsaturated dicarboxylic acids to olefins can range from 0.5:1 up to 4:1, more preferably from 0.5:1 up to 3:1. The molar ratio of compounds comprising a hydrophilic moiety to unsaturated dicarboxylic acids are suitably from 0.5:1 up to 3:1 more preferably from 1:1 up to 2:1. According to this reaction path the obtained copolymer (emulsifier) can have a molar ratio of olefins to unsaturated dicarboxylic acids around 1:1.

According to another preferred embodiment the copolymer is accessible from already esterified unsaturated dicarboxylic acids which are copolymerised with olefins. This process can be characterised in that olefins and esterified unsaturated dicarboxylic acids are copolymerised at temperatures from about 120° C. up to 250° C. in the presence of a peroxide catalyst and an inert gas atmosphere. The molar ratio of esterified unsaturated dicarboxylic acids to olefins in the reaction mixture may vary from 1.0.5 up to 1:7. According to this embodiment copolymers are suitably obtained having a molar ratio of olefins to unsaturated dicarboxylic acids ranging from 0.5:1 up to 4:1.

Furthermore, the copolymer suitably has a main chain consisting of carbon atoms. The esterified copolymer used in this invention are suitably produced by Akzo Nobel N.V and sold under the names Dapral such as Dapral GE 202 ©.

The present invention provides both a substantially water-free sizing composition and an aqueous sizing dispersion. By substantially water-free is meant that a small amount of water can be present; the water content can be from 0 up to 10% by weight, suitably less than 5% by weight and preferably less than 2%. Most preferably it contains no water.

The substantially water-free composition suitably contains the emulsifier from about 0.1 up to 50 weight %, more preferably from 0.5 up to 20 weight % and most preferably from 5 up to 15 weight %, the rest in said compositions being substantially 15 cellulose-reactive sizing agent. The copolymer is preferably mixed with the cellulose-reactive sizing agent under gentle heating, suitably at a temperature from 30° C. up to 100° C. The substantially water-free composition according to the present invention has excellent storage stability due to the absence of chemical moieties which reacts with the cellulose-reactive sizing agent. Hence, the sizing composition can be formulated at a location other than the location for intended use. The composition can be stored for extended periods of time at elevated temperatures without impairing the particle size and/or particle size distribution and/or loosing sizing performance.

The substantially water-free composition is preferably emulsified immediately before being feed to the wet stock. However, the substantially water-free composition may be introduced directly into the wet stock provided that proper amount of shear forces are present in order to attain suitable particle size of the cellulose-reactive s:zing agent. The composition is preferably emulsified in the presence of an aqueous phase. The present substantially water-free composition is preferably emulsified using low-shear forces. The distinction between high shear and low shear conditions is well known in the art. Low-shear forces are preferably introduced without the necessity of high shear turbine pumps or high pressure homogenisation, but merely by stirring, by using low-shear venturi system, by passing through a mixing valve, or by using agitation present in the paper stock preparation system. Moreover, shear forces can also be introduced by using an impeller stirrer. Regardless by which means the shear forced are applied the resulting aqueous emulsion has a narrow particle size distribution an appropriate particle size.

The aqueous sizing dispersion preferably has at least about 0.5 weight % of cellulose-reactive sizing agent, more preferably from about 0.5 up to 20 weight % and most preferably from 1 up to 5 weight %.

According to yet another preferred embodiment of the invention the composition and/or dispersion can comprise common fixing agents, stabilising agents and/or activators, (hereinafter called additives) known to the person skilled in the art such as anionic compounds, cationic compounds or amphoteric compounds or mixtures thereof exemplified by cationic or amphoteric starch, polyamine, polyamideamine, or additional vinyl addition polymers. These additives are suitably added when preparing the aqueous dispersion more preferably they are added subsequent the emulsification.

The composition/emulsion of this invention can be used as sizing agent in conventional manner in a process for the production of paper or board using any type of cellulosic fibres. Preferably, the present invention can be used in a process for the production of paper or board by the addition of the composition or the aqueous emulsion of a sizing agent to a stock containing cellulosic fibres and optional fillers, dewatering the stock on a wire to obtain paper or board and white water. Furthermore, the use of the emulsion is not limited to internal sizing, thus the emulsion is also used for surface or stock sizing. The term "paper" should be interpreted in a wide meaning including all types of cellulose-based products in sheet or web form such as board and paperboard. The stock comprises cellulosic fibres, optionally in combination with mineral fillers with a content of cellulosic fibres of at least 50% by weight, based on dry stock. Examples of mineral fillers include kaolin, china clay, titanium oxide, gypsum, talc and natural and synthetic calcium carbonates such as chalk, ground marble and precipitated calcium carbonate. The amount of cellulose-reactive sizing agent added to the stock can vary from 0.01 up to 5% by weight suitably from 0.05 up to 1.0% by weight, based on dry weight of cellulosic fibres and optional fillers, where the dosage mainly is dependent on the quality of the pulp or paper, the sizing agent used and the level of sizing desired.

Conventional chemicals added to the stock in papermaking such as retention aids, aluminium compounds, dyes, wet-strength resins, optical brightening agent can be used together with the present sizing composition/emulsion. Examples of suitable retention aids include cationic polymers or cationic inorganic materials in conjunction organic polymers, such as bentonite in combination with cationic polymers, silica-based sols in combination with cationic polymers or cationic and anionic polymers. Particularly good stock sizing can be achieved when using the composition/emulsion of the invention with retention aids comprising cationic polymers. Suitable cationic polymers include cationic starch, guar gum, acrylate and acrylamide-based polymers, polyethyleneimine, dicyanamide-formaldehyd, polyamines, polyamidoamines and poly (diallyldimethyl ammoniumchloride) and combinations thereof. Cationic starch and calionic acrylamide-based polymers are preferably used, either alone or in combination. In a preferred embodiment of the invention, the emulsions are used in combination with a retention systemr comprising at least one cationic polymer and anionic silica-based particles. The present emulsion can be added before, between, after or simultaneously with the addition of the cationic polymer or polymers. It is also possible to pre-mix the size emulsion with a retention aid, e.g. a cationic polymer or an anionic silica-based material, prior to introducing the mixture thus obtained into the stock.

The invention is further illustrated in the following examples, which, however, are not intended to limit the same. Parts and % relate to parts by weight and % by weight, respectively, unless otherwise stated

EXAMPLE 1

Materials

Alkenyl Succinic Anhydride

The sizing agent used is the reaction product of maleic anhydride and straight-chain internal C16/18 olefin.

Emulsifier

Different emulsifiers according to the invention are produced by the copolymerisation of an α-olefin and maleic anhydride esterified with 1 mol of methyl polyethylene glycolether (MPEG) per 1 mol of maleic anhydride. The emulsifier products are specified in the table below in terms of chain length of the starting α-olefin, molar ratio of α-olefin to esterified maleic anhydride to and molecular weight of the methyl polyethylene glycol (MPEG).

TABLE I

| Emulsifier | α-olefin | molar ratio | MPEG |
|---|---|---|---|
| A | C14/16 | 1:1 | 350 |
| B | C14/16 | 1:1 | 750 |
| C | C20/24 | 1;1 | 750 |
| D | C20/24 | 1:1 | 1000 |
| E | C14/16 | 2:1 | 350 |
| F | C14/16 | 2:1 | 750 |

Preparation of Sizing Compositions

The emulsifier (A-F) is mixed in an appropriate amount with ASA, yielding a clear solution. This mixture is kept for at least 2 hour at 80 $^{0}$c before the full emulsifying power is obtained.

Each of the sizing compositions containing the emulsifiers are evaluated regarding particle size distribution subsequent emulsification. The emulsification in water is accomplished within a set period of time at low shear by means of an impeller stirrer. A beaker (250 ml) is charged with 100 ml of cold tap water. 3 g of the ASA/enmuisifier composition is added under stirring (1600 rpm). The resulting compositions/emulsions are analysed for particle size distribution using a Mastersizer $\mu$ (Malvern Instrumen's). The results, which are obtained with different emulsifiers, are summarised in table II. 50%, (90%) of all particles are not greater than the number given by Dv 50 (Dv 90). Small particles, in particular the 90% value is a prerequisite for good sizing performance.

TABLE II

ASA and emulsifier blended at 80° C. during 2 hours. The emulsification was performed after 1 month storage time at 20° C.

| Emulsifier | % on ASA | Dv 50, $\mu$m | Dv 90, $\mu$m |
|---|---|---|---|
| A | 10 | 0.74 | 1.35 |
| B | 10 | 1.01 | 2.17 |
| c | 10 | 1.00 | 2.16 |
| D | 10 | 1.75 | 3.75 |
| E | 10 | 2.15 | 3.41 |
| F | 10 | 2.15 | 6.70 |

EXAMPLE 2

The emulsifiers of the present invention are compared with prior art emulsifiers. Emulsifier A, according to the invention, is compared to an emulsifier generated in-situ by reacting an appropriate amount of polyethylene glycol precursor (PEG) or methoxy polyethylene glycol precursor (MPEG) with ASA. The effective amount of emulsifier content is the sums of added PEG or MPEG and the equivalent of ASA that is esterified with the PEG or MPEG. It is taken into account that also the polymeric emulsifier of the present invention contains up to 2 weight % of MPEG, which reacts with ASA, thus yielding a higher effective emulsifier concentration.

The ASA/emulsifier compositions of the following examples are made by mixing into ASA an appropriate amount of PEG, MPEG or polymeric emulsifier of the present invention, respectively, so that the resulting composition is 200 g in total with an effective emulsifier concentration of 12% by weight. The compositions are made at 80° C. under stirring with a magnetic stirrer and they are kept for additional 2½ hour in a sealed glass at 80° C. in an oven.

TABLE III

| Emulsifier or precursor | % added on ASA* | Dv 50, $\mu$m | Dv 90, $\mu$m |
|---|---|---|---|
| A | 10 | 0.76 | 1.34 |
| MPEG 750 | 8.1 | 2.60 | 17.5 |
| MPEG 1000 | 7.0 | 2.58 | 8.23 |

*resulting in 12% effective emulsifier after reaction with ASA

Table III show that the emulsifiability of a sizing composition of the present invention after storage is significantly improved compared to prior art emulsifiers.

EXAMPLE 3

Sizing tests are performed using a furnish of a 70/30 blend of hardwood/softwood (36° SR freeness). AS filler is used 15 weight % calciumcarbonate (Albacar HO) and the retention system was Compozil S with 1 weight % cationic potato starch (Hi-Cat 142, Roquette) and 0.5 weight % silicasol BMA-0 (Eka Chemicals). Aluminium sulphate is used at an amount of 0.15 weight %, resulting in a pH of 7.8 in the headbox.

The ASA emulsion used as sizing agent is prepared by emulsification of an ASA-emulsifier composition with 10 weight % of emulsifier A (Dapral GE202) according to example 1. The sizing results at different addition rates and the particle size distribution of the ASA emulsions are shown in table IV.

TABLE IV

| ASA emulsifier | Particle size, $\mu$m Dv 50 | Particle size, $\mu$M Dv 90 | Addition kg/t | Cobb 60, g/m$^3$ | HST 80, s |
|---|---|---|---|---|---|
| A Dapral GE 202 | 0.78 | 1.38 | 1.0 | 30.2 | 102 |
| | | | 1.25 | 26.3 | 126 |
| Starch | 1.10 | 2.36 | 1.0 | 29.4 | 99 |
| | | | 1.25 | 25.1 | 146 |

From table IV it is apparent, that the composition according to the invention shows excellent sizing properties.

What is claimed is:

1. A substantially water-free sizing composition which comprises a cellulose-reactive sizing agent and a copolymer functioning as an emulsifier, wherein the copolymer is prepared from a monomer mixture comprising one or more olefins and one or more esterified unsaturated dicarboxylic acids.

2. An aqueous sizing dispersion which comprises a cellulose-reactive sizing agent and a copolymer functioning as an emulsifier, wherein the copolymer is prepared from a monomer mixture comprising one or more olefins and one or more esterified unsaturated dicarboxylic acids.

3. The sizing composition of claim 1, wherein the derivatives of the unsaturated dicarboxylic acids are esaterified α-β unsaturated dicarboxylic acids.

4. The sizing composition of claim 1, wherein the derivatives of the unsaturated dicarboxylic acids are monoesters of unsaturated dicarboxylic acids.

5. The sizing composition of claim 1, wherein the derivatives of the unsaturated dicarboxylic acids are diesters of unsaturated dicarboxylic acids.

6. The sizing composition of claim 3 wherein the unsaturated dicarboxylic acids are esterified with a compound comprising a hydrophilic moiety.

7. The sizing composition of claim 6 wherein the compound comprising the hydrophilic moiety is a polyalkylene oxide alkyl ether.

8. The sizing composition of claim 7 wherein the polyalkylene oxide alkyl ether contains from 1 up to 45 alkylene oxide groups.

9. The sizing composition of claim 7 wherein the alkyl group of the polyalkylene oxide alkyl ether contains from 1 up to 36 carbon atoms.

10. The sizing composition of claim 1 wherein the cellulose-reactive sizing agent is a substituted succinic anhydride or a 2-oxetanone compound.

11. The sizing composition of claim 1 wherein the olefins are α-olefins.

12. The sizing composition of claim 11 wherein the α-olefins are linear or branched α-olefins comprising from 3 up to 36 carbon atoms.

13. The sizing composition of claim 1 wherein the copolymer has a main chain consisting of carbon atoms.

14. The sizing dispersion of claim 2 wherein the derivatives of the unsaturated dicarboxylic acids are esterified α-β unsaturated dicarboxylic acids.

15. The sizing dispersion of claim 2 wherein the derivatives of the unsaturated dicarboxylic acids are monoesters of unsaturated dicarboxylic acids.

16. The sizing dispersion of claim 2 wherein the derivatives of the unsaturated dicarboxylic acids are diesters of unsaturated dicarboxylic acids.

17. The sizing dispersion of claim 14 wherein the unsaturated dicarboxylic acids are esterified with a compound comprising a hydrophilic moiety.

18. The sizing dispersion of claim 17 wherein the compound comprising the hydrophilic moiety is a polyalkylene oxide alkyl ether.

19. The sizing dispersion of claim 18 wherein the polyalkylene oxide alkyl ether contains from 1 up to 45 alkylene oxide groups.

20. The sizing dispersion of claim 18 wherein the alkyl group of the polyalkylene oxide ether contains from 1 up to 36 carbon atoms.

21. The sizing dispersion of claim 2 wherein the cellulose-reactive sizing agent is a substituted succinic anhydride or a 2-oxetanone compound.

22. The sizing dispersion of claim 2 wherein the olefins are α-olefins.

23. The sizing dispersion of claim 22 wherein the α-olefins are linear or branched α-olefins comprising from 3 up to 36 carbon atoms.

24. The sizing dispersion of claim 2 wherein the copolymer has a main chain consisting of carbon atoms.

* * * * *